United States Patent [19]

Fukushima

[11] Patent Number: 4,943,833

[45] Date of Patent: Jul. 24, 1990

[54] COLOR COPYING APPARATUS AND METHOD

[75] Inventor: Shigenobu Fukushima, Osaka, Japan

[73] Assignee: Minolta Camera Kabushiki Kaisha, Osaka, Japan

[21] Appl. No.: 369,058

[22] Filed: Jun. 20, 1989

[30] Foreign Application Priority Data

Jun. 21, 1988 [JP] Japan ..... 63-152632
Jun. 21, 1988 [JP] Japan ..... 63-152633

[51] Int. Cl.[5] ..... G03G 15/01

[52] U.S. Cl. ..... 355/326; 355/218; 355/244; 346/157

[58] Field of Search ..... 355/326, 266, 245, 319, 355/321, 318, 202, 244, 218, 271; 346/153.1, 160, 157

[56] References Cited

U.S. PATENT DOCUMENTS 3,960,445 6/1976 Drawe ..... 355/326
4,579,443 4/1986 Abuyama et al. ..... 355/326 X
4,627,707 12/1986 Tatsuo et al. ..... 355/218
4,710,016 12/1987 Watanabe ..... 355/326
4,743,945 5/1988 Masazumi et al. ..... 355/[illegible]
4,761,669 8/1988 Langdon ..... 355/326
4,769,675 9/1988 Watanabe ..... 346/157 X
4,816,869 3/1989 Kasai et al. ..... 355/326 X
4,819,028 4/1989 Abe ..... 355/326 X
4,847,654 7/1989 Honma et al. ..... 346/160 X

FOREIGN PATENT DOCUMENTS 56-162755 12/1981 Japan .
59-52811 12/1984 Japan .

*Primary Examiner*—A. C. Prescott
*Attorney, Agent, or Firm*—Willian Brinks Olds Hofer Gilson & Lione

[57] ABSTRACT

A copying apparatus carrying out copying by turning latent electrostatic images formed on a photoreceptor drum into toner images and by transferring the same on a sheet of copy paper comprises a latent electrostatic image forming unit for forming latent electrostatic images on the photoreceptor drum, a toner color selector for separately selecting a color for the images of an original and a color for images of additional information such as date or the like, and a transfer apparatus for transferring the toner images again on a sheet of copy paper which has been already copied. The images of an original are copied in a first color, and thereafter the images of the additional information are copied in a second color, so that a copy is provided in which the images of the original and the images of the additional information are formed in different colors.

7 Claims, 18 Drawing Sheets

COLOR COPYING APPARATUS AND METHOD

CROSS REFERENCE TO RELATED APPLICATIONS

A related copending application of particular interest to the instant application is U.S. Ser. No. 232,781, entitled "Copying Machine", filed Aug. 16, 1988 and assigned to the same assignee of the instant application.

BACKGROUND OF THE INVENTION

1. Field of the Invention

The present invention relates to a copying apparatus and an operating method therefor and, more particularly, to a copying apparatus and an operating method therefor in which images of an original are copied on a sheet of copy paper and additional information such as date or page number can be entered on the same sheet.

2. Description of the Related Art

A copying apparatus capable of recording additional information such as date and page number on a sheet of copy paper as well as images of an original is disclosed in Japanese Patent Publication No. 59-52811/1984.

In the copying apparatus disclosed in the above mentioned publication, images of an original are scanned and exposed to be projected on a photoreceptor and first latent electrostatic images corresponding to the original images are formed on the photoreceptor. When the first latent electrostatic images are formed on the photoreceptor, a portion of the optical path projecting the images of the original is partially intercepted, in order to reserve charges on that area of the photoreceptor on which the additional information is to be entered. Second latent electrostatic images corresponding to the additional information are formed by means of a liquid crystal head on that area on which the charges are reserved, and thereafter the first and second latent electrostatic images are developed simultaneously by one developing unit.

However, in the copying apparatus disclosed in the above mentioned publication, the images of the original and the additional information can be formed on the sheet of paper in only one color. Namely, the images of the original cannot be formed in a color different from that of the additional information.

SUMMARY OF THE INVENTION

Therefore, one object of the present invention is to provide a copying apparatus capable of forming images of an original and images of additional information in two different colors.

Another object of the present invention is to provide a copying apparatus capable of forming images again on a sheet of paper on which images have been formed in order to form images of an original and images of additional information in two different colors.

A further object of the present invention is to provide a copying apparatus in which images of an original and images of additional information are formed on a sheet of paper in two different colors, and in which both images do not overlap with each other on the sheet of copy paper.

A still further object of the present invention is to provide a method of copying images by which images of an original and images of additional information can be formed in two different colors.

The above described objects of the present invention can be attained by a copying apparatus in accordance with the present invention, comprising: a table on which an original is placed; a photoreceptor; a first latent electrostatic image forming apparatus for forming a first latent electrostatic image on the photoreceptor based on an image of the original; an apparatus for supplying electric signal indicative of additional information; a second latent electrostatic image forming apparatus for forming a second latent electrostatic image on the photoreceptor based on the electric signal; a plurality of developing apparatuses containing toners of different colors for turning the latent electrostatic images formed on the photoreceptor into toner images; a first designating apparatus for designating the color of the toner in which the first latent electrostatic image formed by the first latent electrostatic image forming apparatus is to be developed; a second designating apparatus for designating the color of the toner in which the second latent electrostatic image formed by the second latent electrostatic image forming apparatus is to be developed; a transfer apparatus for transferring toner images on the photoreceptor onto a sheet of copy paper at a transferring position; a paper re-feeding apparatus for feeding again the sheet of copy paper on which the toner images have been transferred to the transfer position; an apparatus for determining whether or not the colors of the toners designated by the first and the second designating apparatuses are the same; a first controlling means for controlling the copying apparatus such that the first latent electrostatic image and the second latent electrostatic image are simultaneously formed on the photoreceptor by the first and second latent electrostatic image forming apparatuses and developed by the designated color to be transferred to the sheet of copying paper when the colors of the toners designated by the first and second designating apparatuses are the same; and a second controlling apparatus for controlling the copying apparatus such that the latent electrostatic image is formed by either one of the first and second latent electrostatic image forming apparatuses, developed by a toner of the designated color to be transferred to the sheet of copy paper and thereafter the sheet of copy paper is supplied again to the transfer position by the paper re-feeding apparatus, the latent electrostatic image is formed by the other one of the latent electrostatic image forming apparatuses, and developed by the toner of the designated color to be transferred to the sheet of copy paper fed again to the transfer position.

Since the copying apparatus of the present invention comprises the above described components, the image of the original is transferred in a first toner color and the additional information is transferred onto the copy paper in a second toner color. Therefore, a copying apparatus can be provided in which images of the original and the images of the additional information can be formed in two different colors.

According to a preferred embodiment of the present invention, the second latent electrostatic image forming apparatus forms the second latent electrostatic image on an area of the photoreceptor other than the areas on which the first latent electrostatic image is formed.

In accordance with a preferred embodiment of the present invention, the images of the original and the images of the additional information are formed on different areas of the photoreceptor. Therefore, a copying apparatus can be provided in which the images of the original do not overlap with the images of the additional information on a sheet of copy paper.

In accordance with another aspect of the present invention, a method of copying images comprises the following steps of: forming a first latent electrostatic image on a photoreceptor based on an image of an original; forming a second latent electrostatic image on the photoreceptor based on an electric signal indicative of an additional information; designating the color of a first toner in which the first latent electrostatic image is to be developed; designating the color of a second toner in which the second latent electrostatic image is to be developed; determining whether or not the colors of the first toner and the second toner are the same; forming simultaneously the first and second latent electrostatic images on the photoreceptor and developing the images in the designated first color of the toner to transfer the sane onto a sheet of copy paper when the first and second colors of the toners are the same; and forming the first latent electrostatic image on the photoreceptor, developing the same in the first color of the toner to transfer the same on the sheet of copy paper and thereafter forming the second latent electrostatic image in the second color of the toner to transfer the same to the sheet of copy paper which has been developed in the first color of the toner.

Since the method of copying images of the present invention comprises the above described steps, the images of an original are developed in the first color of the toner and the images of the additional information are developed in the second color of the toner. Therefore, a method of copying images can be provided by which the images of an original and images of the additional information can be formed in two different colors.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

One embodiment of the present invention will be described in the following.

{Overview of the Structure}

Figure 1:
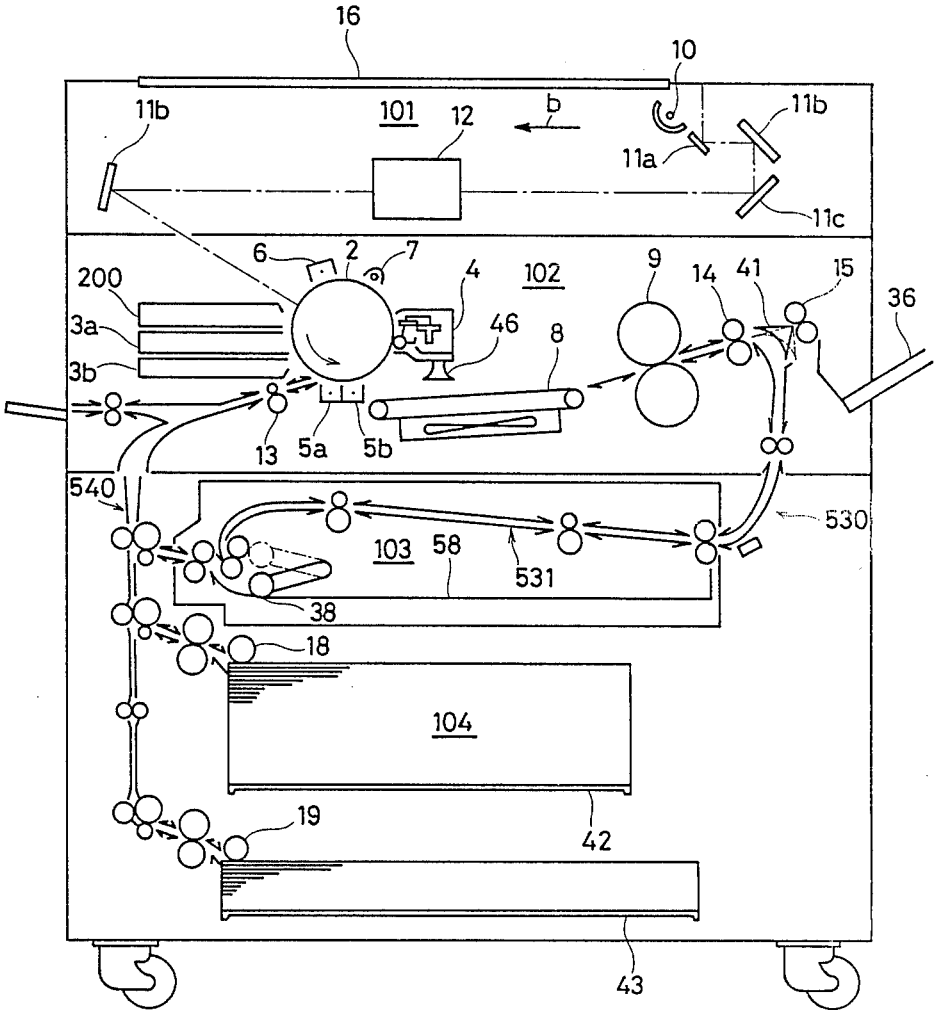
FIG. 1 is a schematic diagram showing a structure of a copying apparatus in accordance with an embodiment of the present invention.
Figure 2:
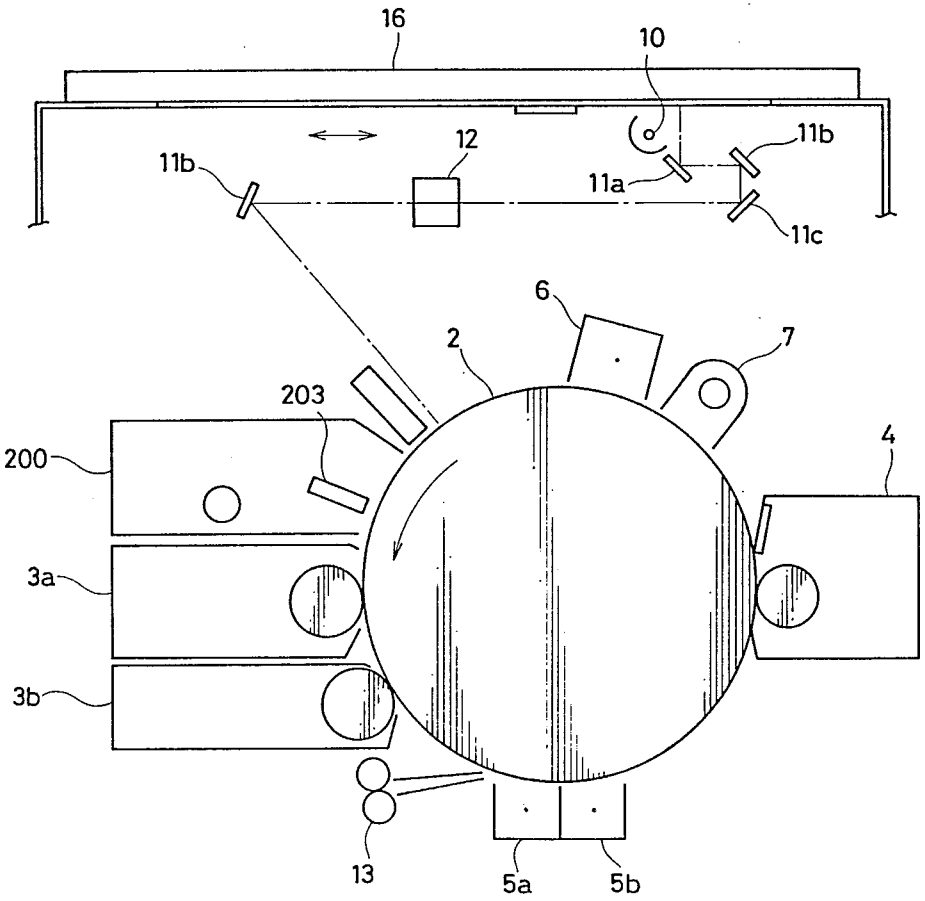
FIG. 2 is an enlarged schematic view showing an optical system and an image forming portion of the copying apparatus.

Referring to FIG. 1, the copying apparatus in accordance with the present invention comprises an optical system 101 provided in an upper stage, an image forming portion 102 provided in an intermediate stage, a paper-refeeding unit 103 provided in a lower stage and a paper feeding unit 104 provided in the lowermost stage.

(i) Optical system 101

The optical system 101 is provided to expose by scanning an original set on a platen glass 16 and to form images from the light reflected from the surface of the original on a surface of a photoreceptor drum 2 in the image forming portion 102.

The optical system 101 comprises an exposure lamp 10, reflecting mirrors 11*a*, 11*b*, 11*c* and 11*d* and a lens 12. The exposure lamp 10 and the reflecting mirror 11*a* reciprocate along the lower surface of the platen glass 16 at the speed of V/n (V; peripheral speed of the photoreceptor drum 2, N; copying magnification), and the reflecting mirrors 11*b* and 11*c* reciprocate along the lower surface of the platen glass 16 at the speed of V/2, to scan and expose the original. The copying magnification is set by adjusting the position of the lens 12. The position of image formation can be corrected by adjusting the angle of the reflecting mirror 11*d*.

(ii) Image forming portion 102

The image forming portion 102 is provided to carry out image formation by a so-called electric photographing process. In other words, latent electrostatic images formed on the photoreceptor drum 2 are developed by a toner. The toner images are transferred onto a sheet of copy paper, fixed thereon, and the sheet of copy paper on which images are copied is discharged.

The image forming portion 102 comprises a photoreceptor drum 2 supported rotatable in the counterclockwise direction as viewed, an eraser lamp 7, a corona charger 6, a data entry unit 200, a developing apparatus 3*a* (containing black toner), a developing apparatus 3*b* (containing red toner), a transfer charger 5*a*, a separating charger 5*b*, a cleaning apparatus 4 arranged around the photoreceptor drum 2, a conveyor belt 8 for conveying the sheets of copy paper on which images are transferred, and a fixing apparatus 9 fixing the toner images of the conveyed paper. The details of the data entry unit 200 will be described later.

A pair of timing rollers 13 transfers the fed sheet of copy paper to the photoreceptor drum 2 and to the transfer charger 5*a* at a prescribed timing in synchronization with the rotation of the photoreceptor drum 2. The pair of rollers 14 and 15 are provided for discharging sheets of copy paper on which images are fixed from the image forming portion 102.

Whether the copy paper discharged from the image forming portion 102 should be discharged on a discharging tray 36 or to a paper-refeeding tray 58, which will be described later, is switched by a switching lever 41 operated by a solenoid, not shown.

(iii) Paper re-feeding unit 103

The paper re-feeding 103 is used for composite copying (in which composite images are formed on the same side of a sheet by two continues image forming processes) and for duplex copying (in which images are formed on the front surface and the rear surface of a sheet by two continuous image forming processes).

More specifically, a sheet of copy paper on one side (first side) of which images are transferred and fixed is transmitted through a passage 530 in composite copying and through the passages 530 and 531 in the duplex copying, to be contained in a paper re-feeding tray 58. Namely, in composite copying, the sheet is contained in the tray 58 with the side on which the images are formed (first side) facing downward and the sheet is contained with the side on which images are formed (first side) facing upward in the duplex copying.

Thereafter, the sheet of the copy paper on which images are fixed on one side is taken out from the tray 58 by means of a paper re-feeding roller 38 at a prescribed timing to be transferred to the timing roller pair 13 through the passage 540. The sheet is again fed to the photoreceptor drum 2 to the transfer charger 5*a* at a prescribed timing, so that images are transferred and fixed thereon. The paper is fed to the photoreceptor drum 2 and to the transfer charger 5*a* with the surface on which images are formed (first side) facing the photoreceptor drum 2 in the composite copying, while the surface on which images are formed (first side) facing the transfer charger 5*a* in duplex copying.

(iv) Paper feed unit 104

The paper feed unit 104 comprises an upper paper feeding tray 42 and a lower paper feeding tray 43 respectively containing sheets of paper of different size. A sheet of paper in respective trays is drawn by a paper feeding roller 18 or 19. Thereafter, the sheet is fed to the timing roller pair 13 of the image forming portion 102 by means of an automatic paper feeding mechanism and transmitted the photoreceptor drum 2 and to the transfer charger 5*a* so that the images are transferred thereon, in response to a prescribed timing signal from the optical system 101 and in synchronization with the rotation of the photoreceptor drum 2.

{Description of the Data Entry Unit 200}

Figure 3:
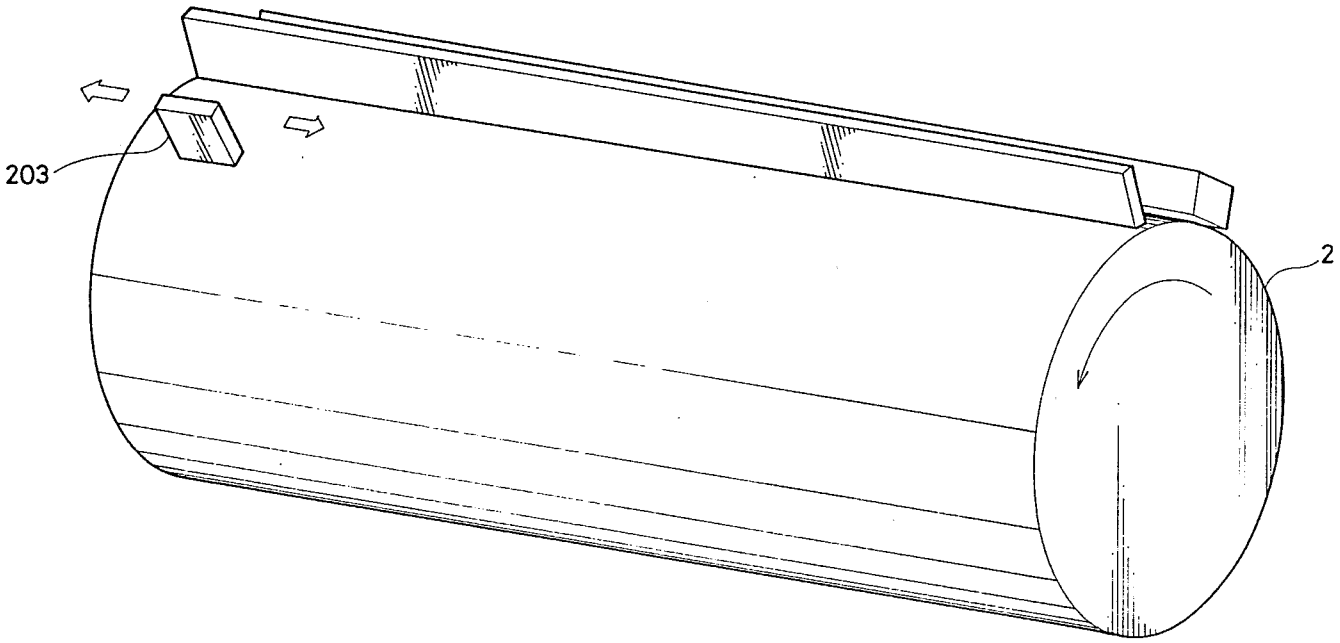
FIG. 3 illustrates positional relations between an LED array mounted on a data entry unit and a photoreceptor drum.

Referring to FIG. 3, the LED array 203 is arranged such that the side of the light emitting surface of the LED element is facing the peripheral surface of the photoreceptor drum 2 and the longitudinal direction of the LED array 203 is in parallel to the actual direction of the photoreceptor drum 2.

The LED array 203 is movable along the axial direction of the photoreceptor drum 2. Consequently, the data of the additional information can be entered in an arbitrary position on the photoreceptor drum 2.

Figure 4:
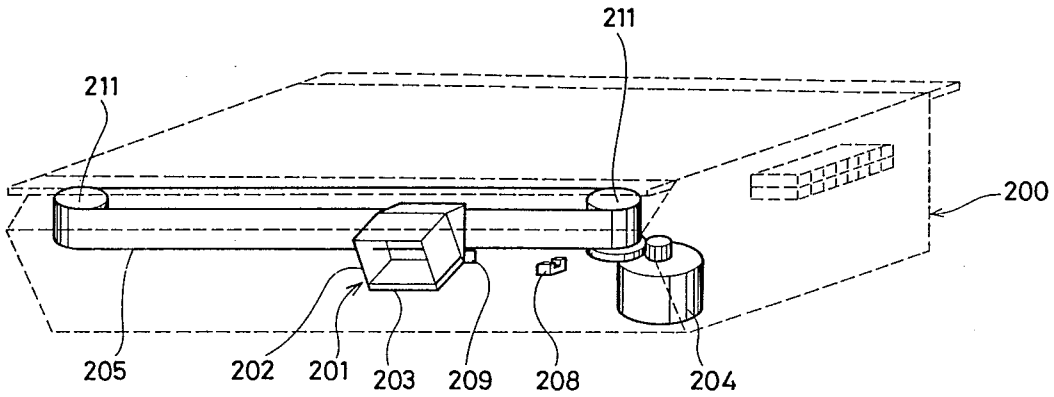
FIG. 4 illustrates a structure of the data entry unit.

Referring to FIG. 4, the LED array 203 is moved by driving the driving pulley 211 by a stepping motor 204 and by rotating the belt 205 suspended between the driving pulley 211 and the driven pulley 211.

More specifically, the data entry head 201 containing a unit of the LED array 203 and the corona charger 202 is fixed on the belt 205 as shown in the figure. Therefore, the data entry head 201 moves along the axial direction of the photoreceptor drum 2 as the belt 205 is rotated. A sensor 208 for detecting a reference position of the data entry head 201 is provided at a prescribed position. The reference position is detected when an optical circuit formed of a concave portion of the sensor 208 is intercepted by an intercepting plate 209 projected from the data entry head 201.

Figure 5:
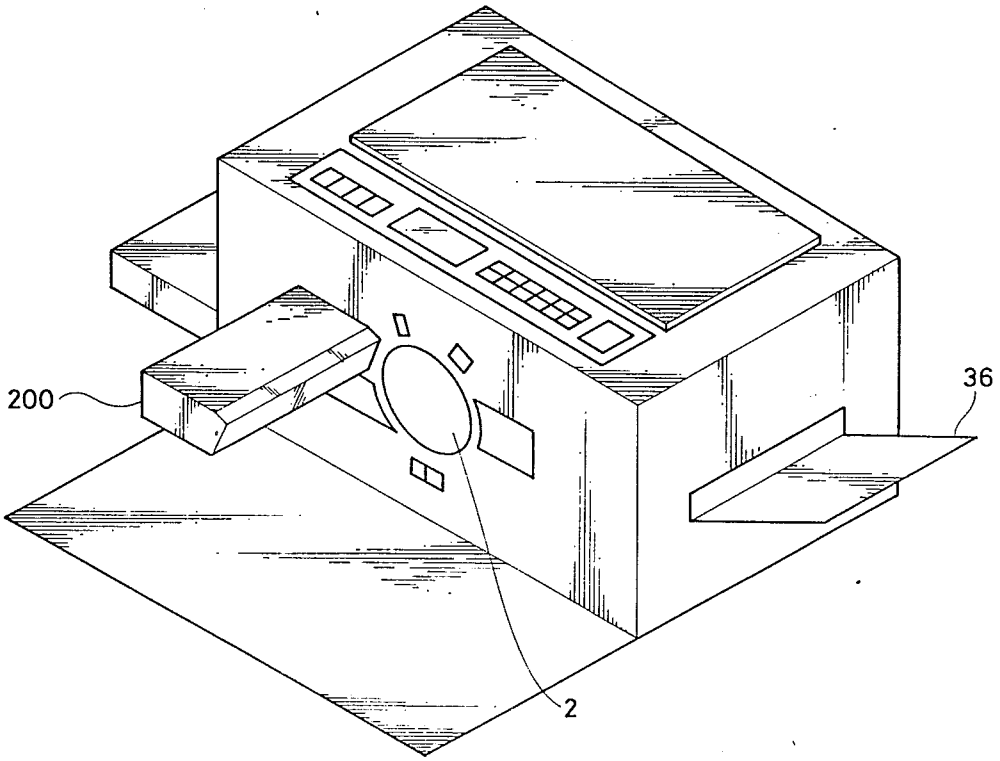
FIG. 5 illustrates attachment/detachment of the data entry unit to and from the copying apparatus.

The data entry unit 200 on which the data entry head 201 is mounted can be attached to and detached from the copying apparatus, as shown in FIG. 5. In addition, the data entry unit 200 is compatible with the developing unit and it can be attached to the copying apparatus.

As described above, in the present embodiment, the length of the data entry head 201 is shorter than the length of the photoreceptor drum 2. The data can be inserted at an arbitrary position by moving the head to an arbitrary position of the photoreceptor drum 2 by a moving mechanism. However, the length of the data entry head 201 is not limited in the present invention. Namely, the present invention can be realized by employing a data entry head having approximately the same length as the photoreceptor drum 2 and by controlling the turning ON/OFF of the LED elements.

{Description of the Operation Panel}

Figure 6:
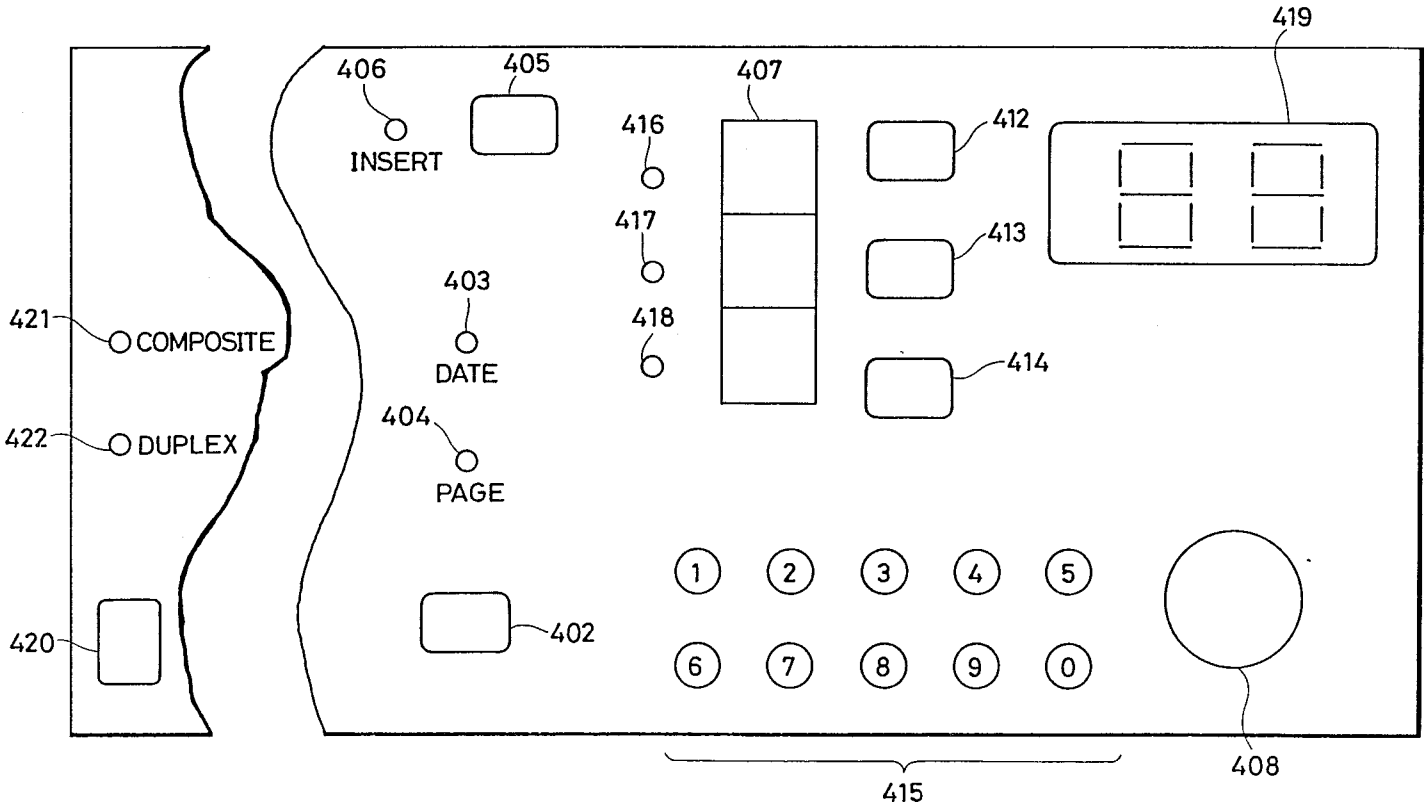
FIG. 6 shows a portion of an operation panel of the copying apparatus.

Referring to FIG. 6, provided on the operation panel are: a ten key group 415 for inputting numerical values such as number of copies and total pages of an original; a copy start key 408 for instructing start of a copying operation; a displaying portion 419 for displaying by segments the numerical values such as the number of copies and the total pages of an original; an entry key 402 for instructing setting of a mode for entering date and/or page; a date LED 403 indicative of the setting of the date entry mode; a page LED 404 indicative of the setting of the page entry mode; an insert key 405 for instructing setting of an insert mode in which designation of information for processing (color of printing data, total page number) for the entry data are received; an insert LED 406 indicative of the setting of the insert mode; color designating keys 412 to 414; displaying LEDs 416 to 418 respectively indicating the designation of the colors corresponding to the keys 412 to 414; a copy mode setting key 420; indicating LEDs 421 and 422 for indicating whether the copy mode is composite mode or duplex mode; and a color displaying space 407 for displaying colors corresponding to the color designating keys 412 to 414. The color designating keys 412 to 414 are also used for designating the color of copies and the color of printing data.

In the foregoing, the color of printing data means the color of printing the entry data.

When the total page number is inputted, the page inserted on the sheet of copy paper is represented as A/B (A: present page, B: total page).

The color designating key 412 corresponds to the toner color of the uppermost developing unit (in the present embodiment, the data entry unit 200 is attached in place of the developing unit in the uppermost stage; the color designating key 413 corresponds to the toner color of the developing unit 3*a* at the intermediate stage; and the color designating key 414 corresponds to the toner color of the developing unit 3*b* at the lower stage.

{Description of the Controlling Circuit}

Figure 7:
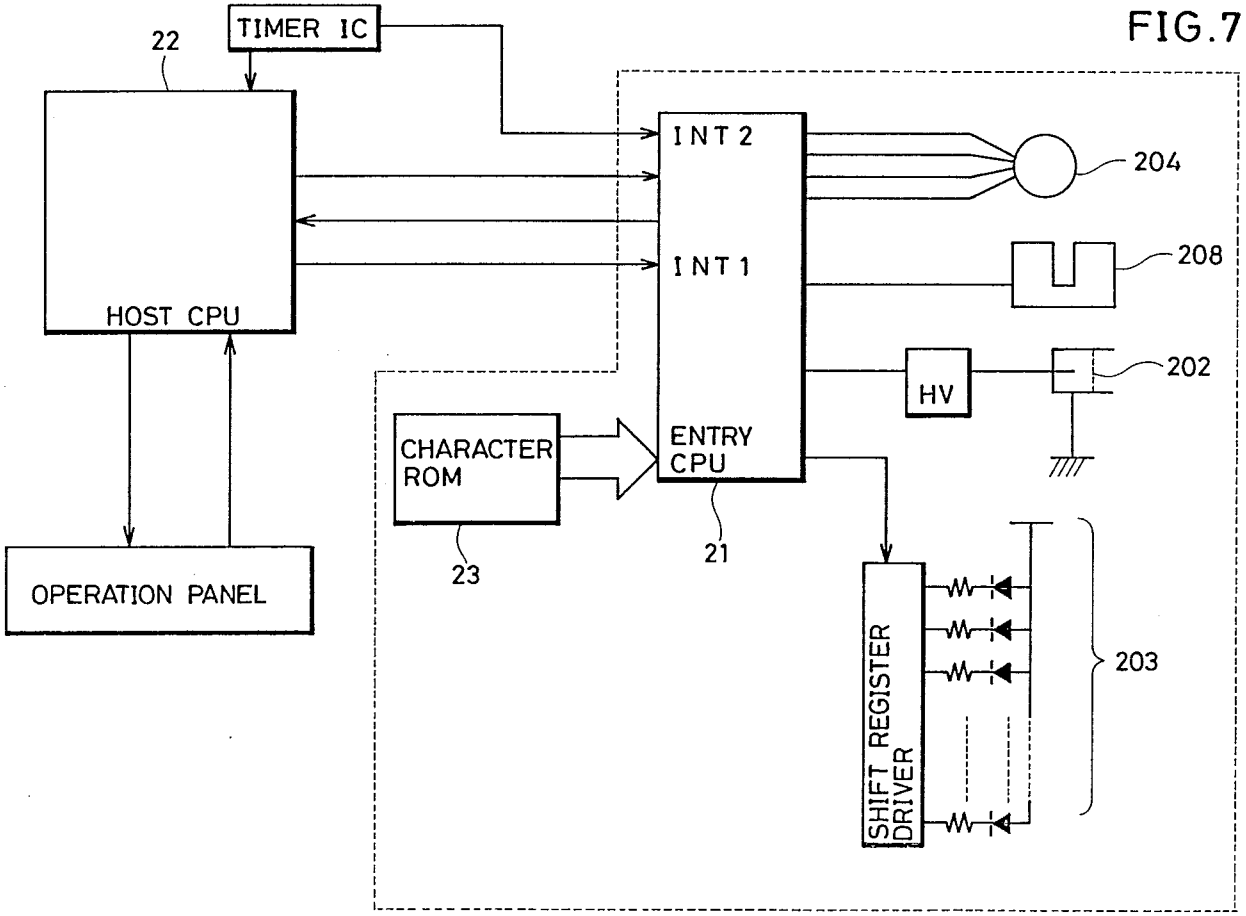
FIG. 7 is a block diagram showing a structure of a controlling circuit of the copying apparatus.

Referring to FIG. 7, the controlling circuit comprises a host CPU 22 controlling the whole operation of the copying apparatus, and an entry CPU 21 controlling the data entry unit 200.

Key input signals from the operation panel, time data from a timer IC, timing data from the entry CPU 21, and various signals from various sensor groups, not shown, arranged at respective portions in the copying apparatus are inputted to the host CPU 22.

Display output signals to the operation panel, entry data (position data, image data and so on) to the entry CPU 21, an image area interruption requesting signal to the entry CPU 21 and driving controlling signals to various members (scanner, developing device, fixing device and so on), not shown, arranged at respective positions of the copying apparatus are outputted from the host CPU 22.

In addition to the signals from the above mentioned host CPU 22, a timer interruption requesting signals from the timer IC, font data from a character ROM and a reference position data from the photosensor 208*a* are inputted to the inserting CPU 21.

In addition to the signals to the host CPU 22, a driving controlling signal to the stepping motor 204, a driving controlling signal to the corona charger 202 and on/off data a driver oft he LED array 203 are outputted from inserting CPU 21.

{Description of the Processes in the CPU}

(1) Description of the main routine (CPU 22)

Figure 8:
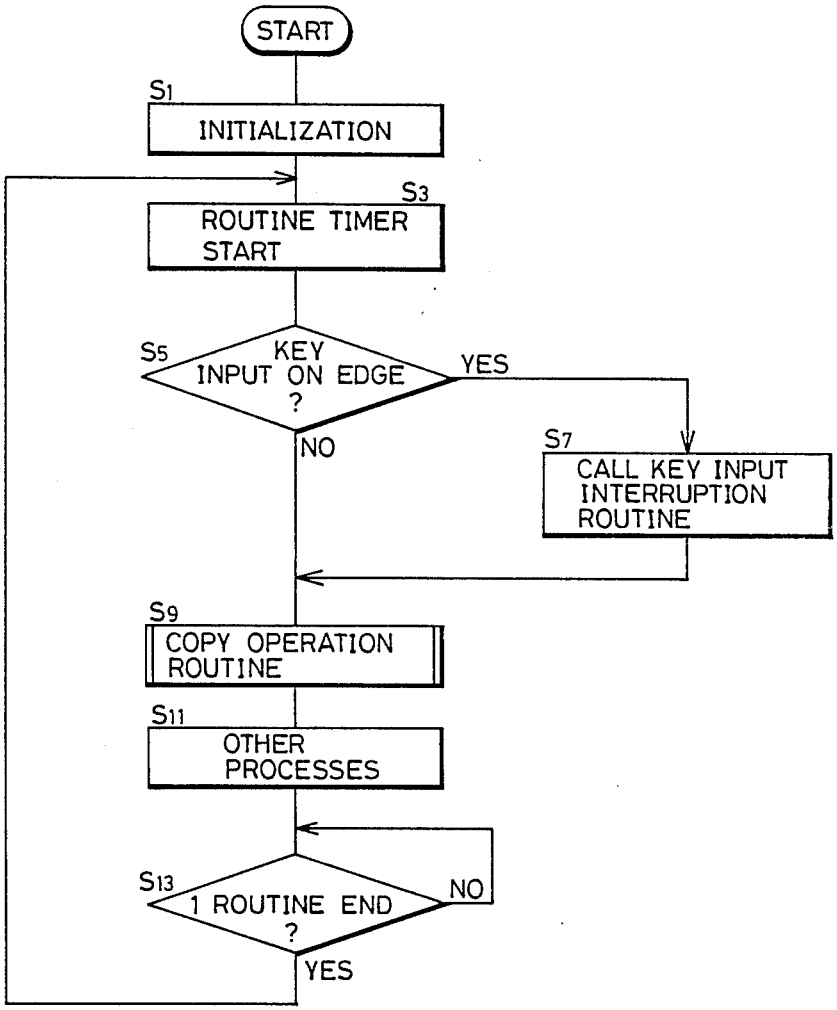
FIG. 8 is a flow chart showing processes in a main routine of a CPU in the copying apparatus.

Referring to FIG. 8, a process of a main routine of the CPU 22 in the copying apparatus of the present embodiment will be described.

The CPU 22 starts processing when the power is turned on, for example. Initialization is carried out at first (S1), and a routine timer for regulating a time of 1 routine is started (S3).

In the step S5, whether or not any one of the keys on the operation panel is pressed is determined.

When any key input is detected, (S5; YES), the flow proceeds to the step S7 to call a key input interruption routine.

In the step S9, a copy operation routine for controlling the copying operation is carried out. In the step S11, other processes are carried out. Thereafter, the flow waits for the end of the operation of the routine timer in the step S13, and the flow returns to the step S3 to repeat the same processes.

The details of the key input interruption routine and the copy operation routine will be described later.

(2) Copy operation routine (S9)

Figure 9:
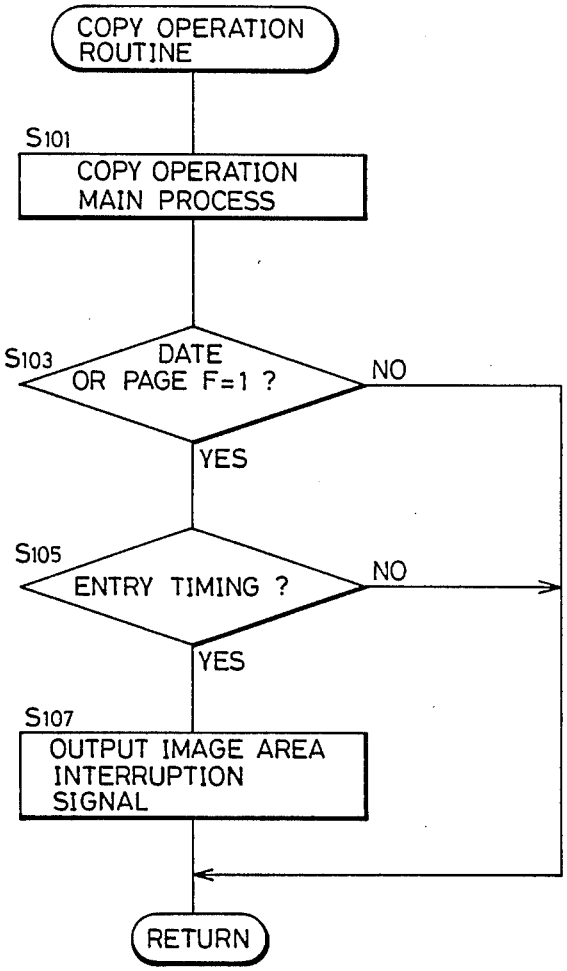
FIG. 9 is a flow chart showing a copying operation routine called in the main routine of the host CPU.

The copy operation routine (S9) called in the main routine of the CPU 22 will be described with reference to FIG. 9.

Processes for controlling an actual copying operation (movement of the scanner, charging, development, transfer, paper feeding, fixing and so on) are known and not the main portion of the present embodiment, so that the detail description is omitted and the copying operation is simply represented as the step S101.

In this routine, the control of the copying operation is carried out (S101) and a signal for requesting image area interruption to the CPU 21 (the CPU controlling the entry of the data) is outputted.

In the step S101, control of the copying operation corresponding to the setting of the composite copying mode or the duplex copying mode set by an operator by means of the copy mode setting key 420 is also carried out. Details of these processes are disclosed in, e.g. U.S. Pat. No. 4,743,945, and therefore, the description thereof is omitted.

When at least one of the date flag and a page flag is set (S3; YES) and entry of data is to be carried out (the position of rotation of the photoreceptor drum is at the position at which the data is to be entered), (S105; YES), the image area interruption signal is outputted (S107) and the image area interruption routine of the CPU 21 is started. The date flag and the page flag are the flags set in correspondence with an ON edge of the entry key 402 as will be described later (the term "ON edge" corresponds to a change of a state of a switch, sensor, a signal or the like from the off state to the on state), wherein the numerals 1 and 0 represents 0=entry mode·OFF 1=entry mode·ON, respectively.

The entry mode will be described later.

Thereafter, the flow returns to the main routine.

(3) Description of the main routine (CPU 21)

Figure 14:
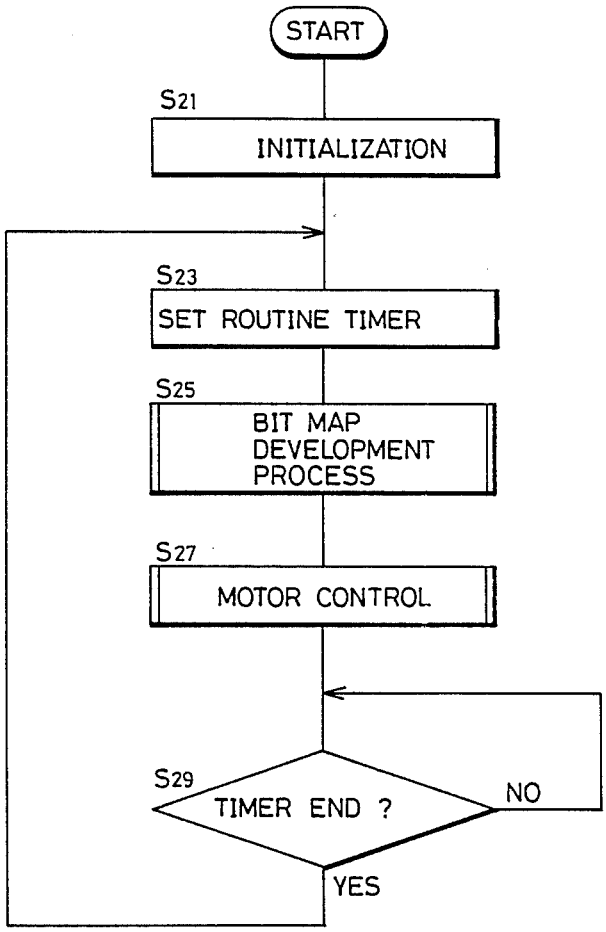
FIG. 14 is flow chart showing a process in the main routine of the CPU in the copying apparatus.

The main routine of the entry CPU 21 will be described in the following with reference to FIG. 14.

First, initialization is carried out in the step S21, and a routine timer is started in the step S23.

Subroutines are called in the steps S25 and S27.

The step S25 is a subroutine in which entry data serially transmitted from the host CPU 22 as code information are developed to bit map information for turning ON/OFF the LED array.

The step S27 is a subroutine for controlling the stepping motor 204 for moving the entry head 201 to a prescribed entry position.

Thereafter, the flow waits for the end of operation of the routine timer for regulating time in the step S29, and then the flow returns to the step S23 to repeat the same processes.

(4) Image area interruption routine

Figure 10:
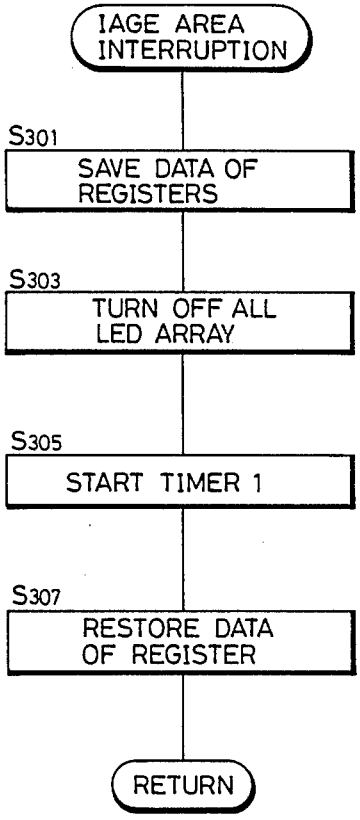
FIG. 10 is a flow chart showing an interruption service routine carried out in an entry CPU corresponding to an image area interruption requesting signal.

The interruption service routine carried out in the CPU 21 in correspondence with the image area interruption requesting signal will be described in the following with reference to FIG. 10.

When an interruption requesting signal from the CPU 22 is received, the CPU 21 stop the process which was being carried out, and starts the process of the present interruption service routine.

At first, in order to start the interrupted process again after the end of the interruption process, data in the respective registers are saved (S301).

Thereafter, all the LED elements of the data entry LED array 203 of the entry head 201 are turned off (S303).

A timer T1 controlled by the timer IC is started (S305). A time period required for the photoreceptor drum to rotate from an image edge position to a position for starting data entry is set as a value t1 of the timer T1. When the counting of the timer is terminated, the timer IC generates a hardware interruption requesting signal to the CPU 21. Upon reception of the timer interruption requesting signal, the CPU 21 starts the timer interruption routine, which will be described later.

After the end of the above described process, the data of the respective registers are restored (S307), the present routine is terminated and the flow returns to the process which was interrupted.

(5) Timer interruption routine

Figure 11A:
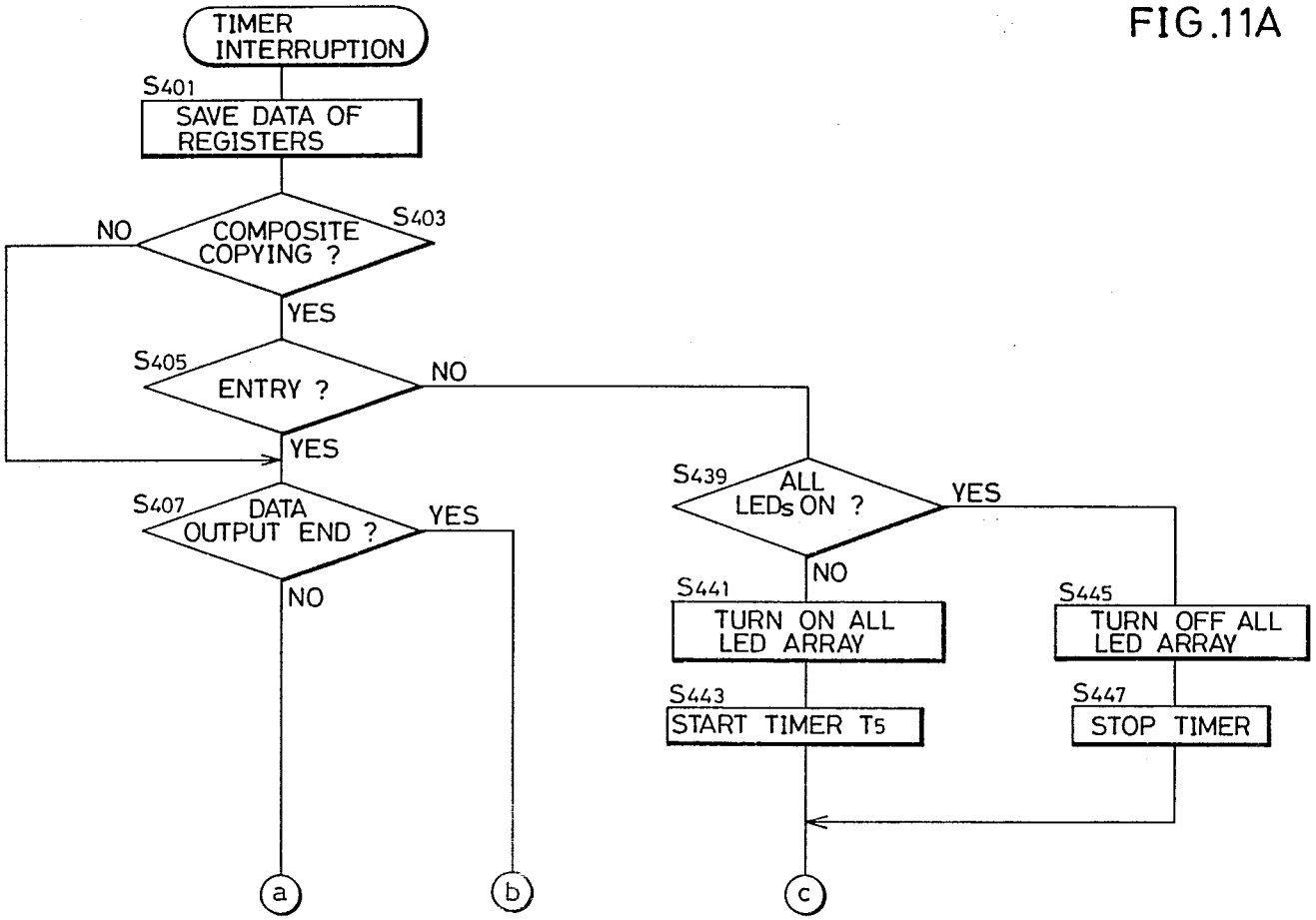
FIG. 11a and 11b are a flow chart showing an interruption service routine carried out in the entry CPU in response to a timer interruption requesting signal.
Figure 11B:
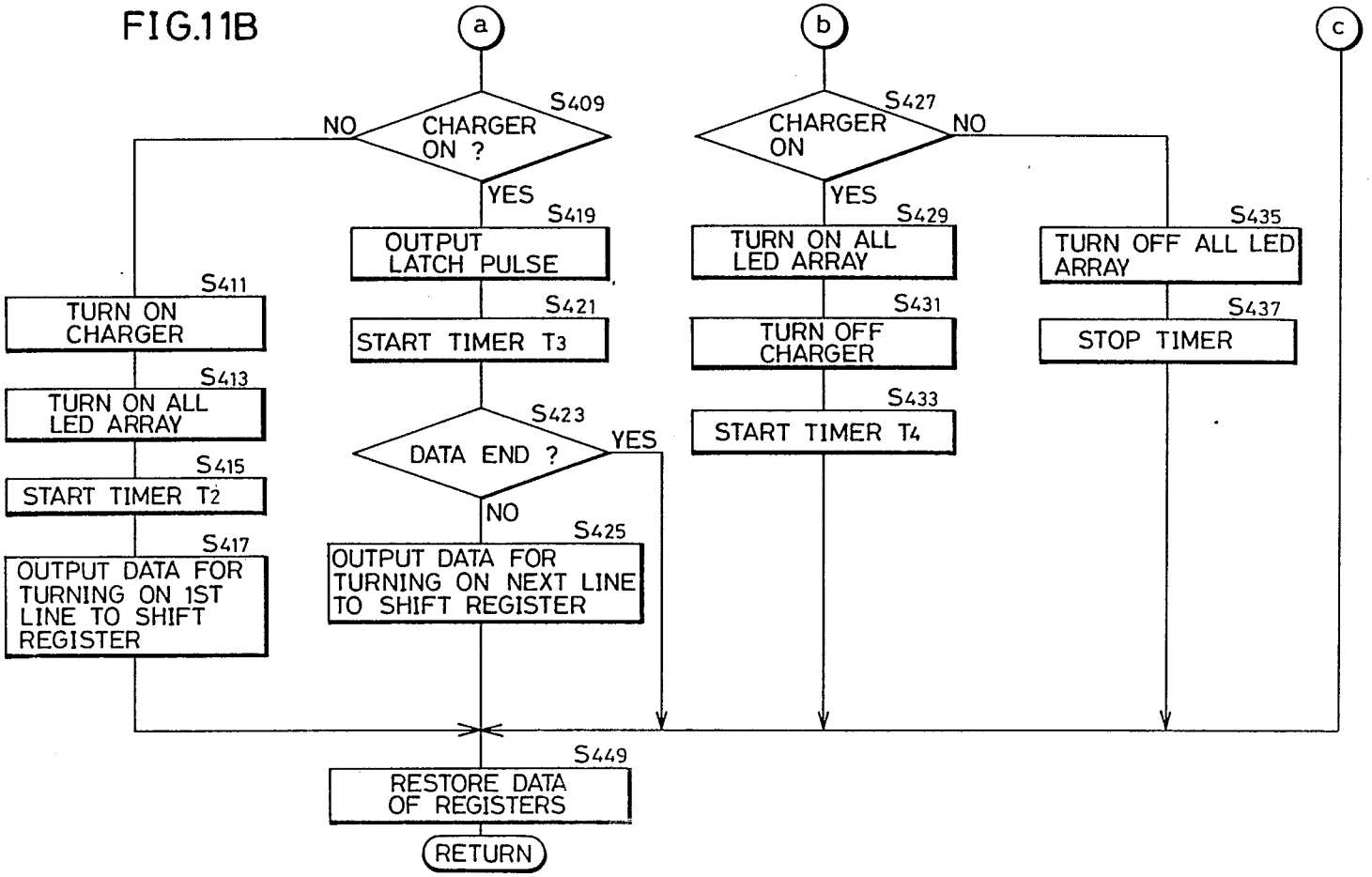
Figure 12A:
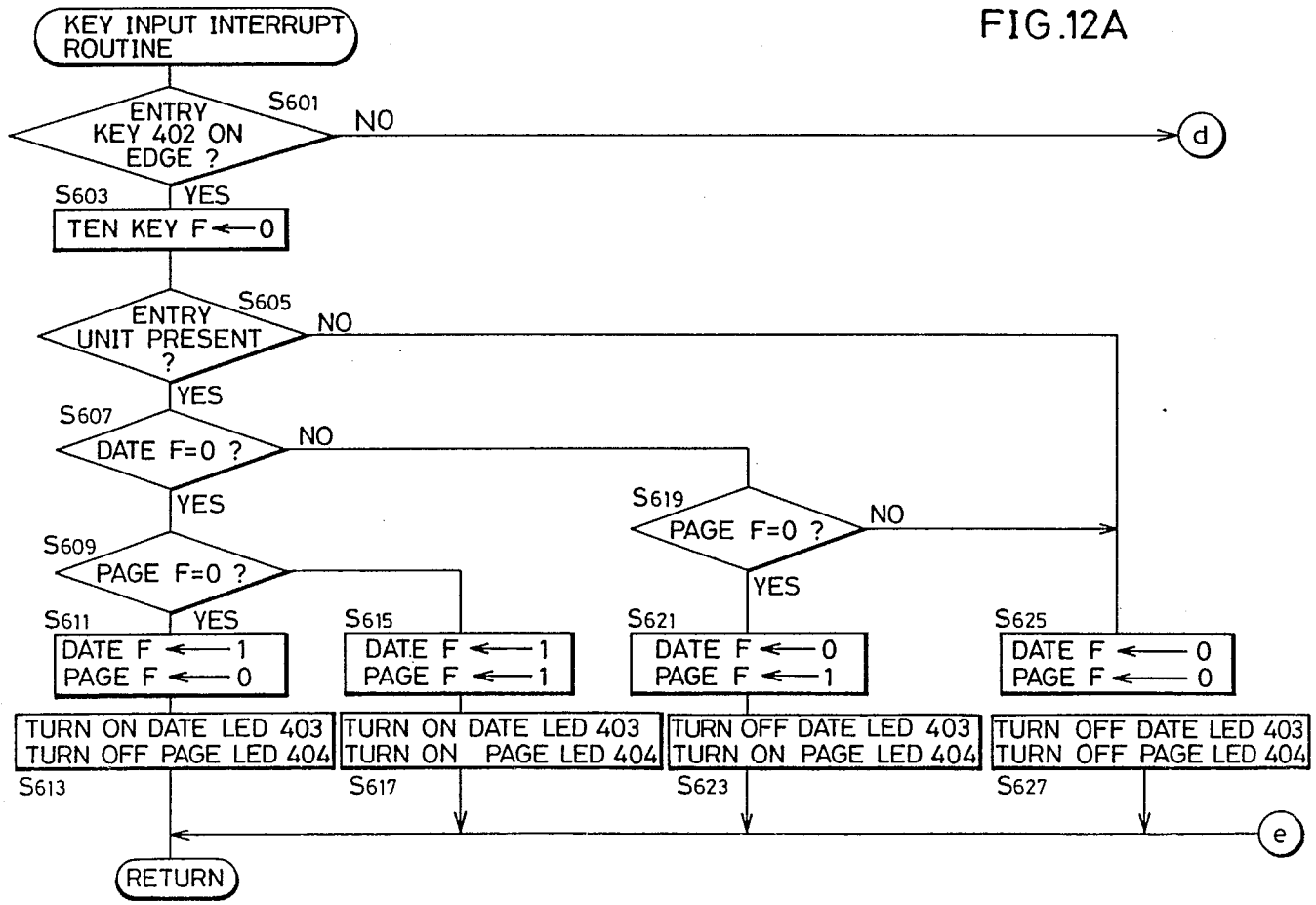
FIG. 12a, 12b, 12c and 12d are a flow chart showing an interruption service routine called by a key input in the main routine of the host CPU.
Figure 12B:
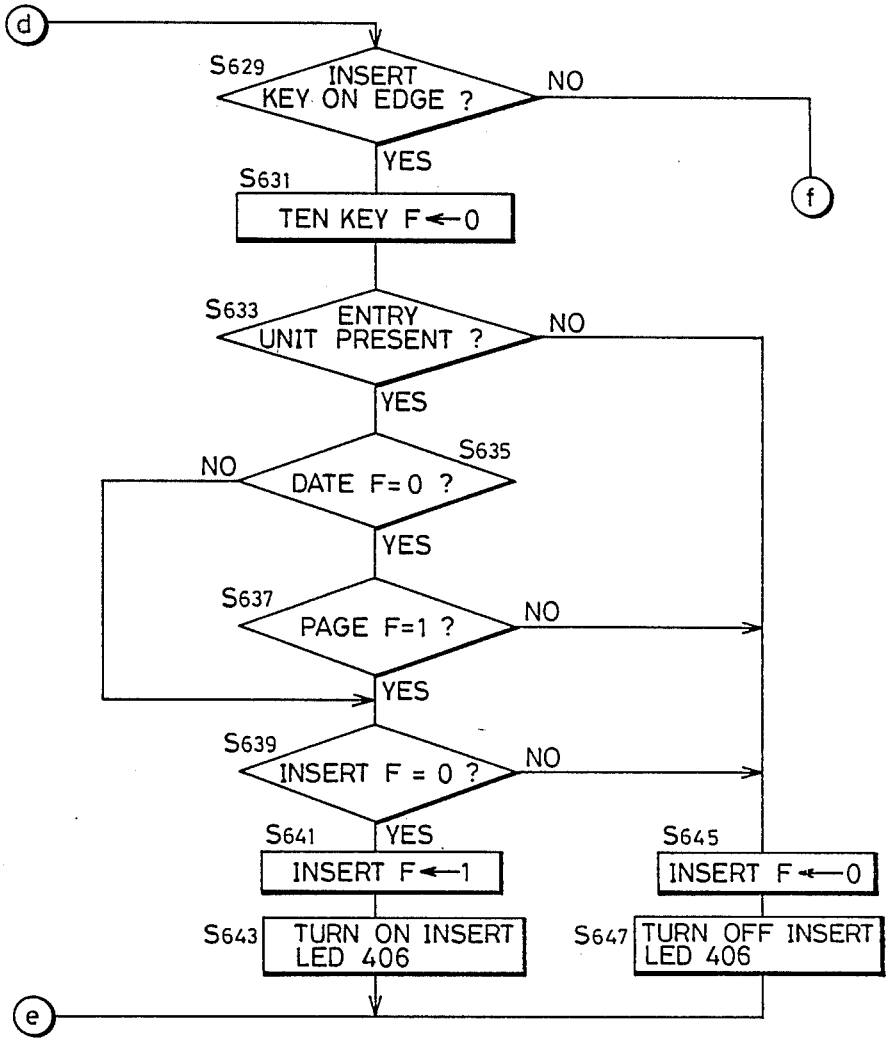
Figure 12C:
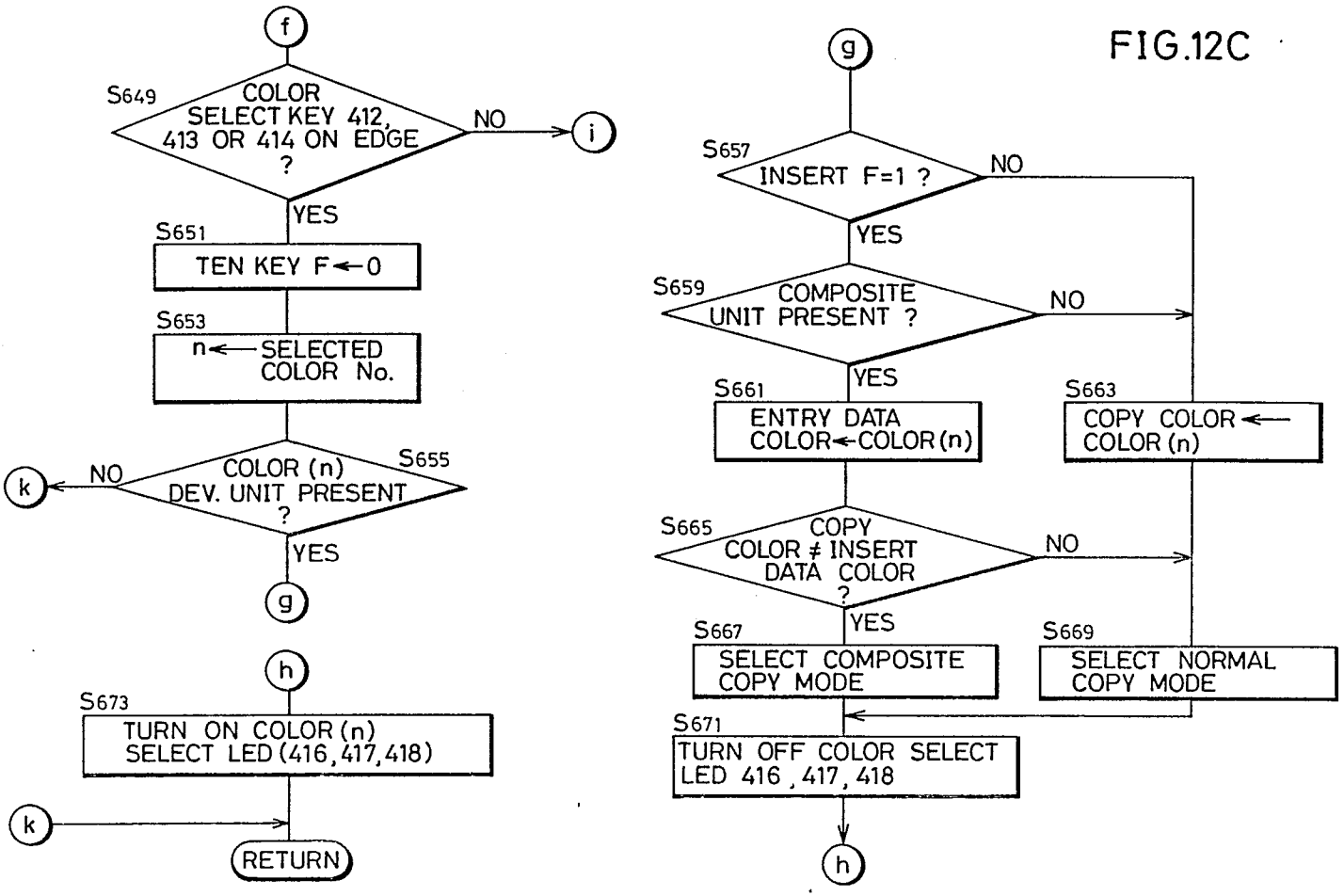
Figure 12D:
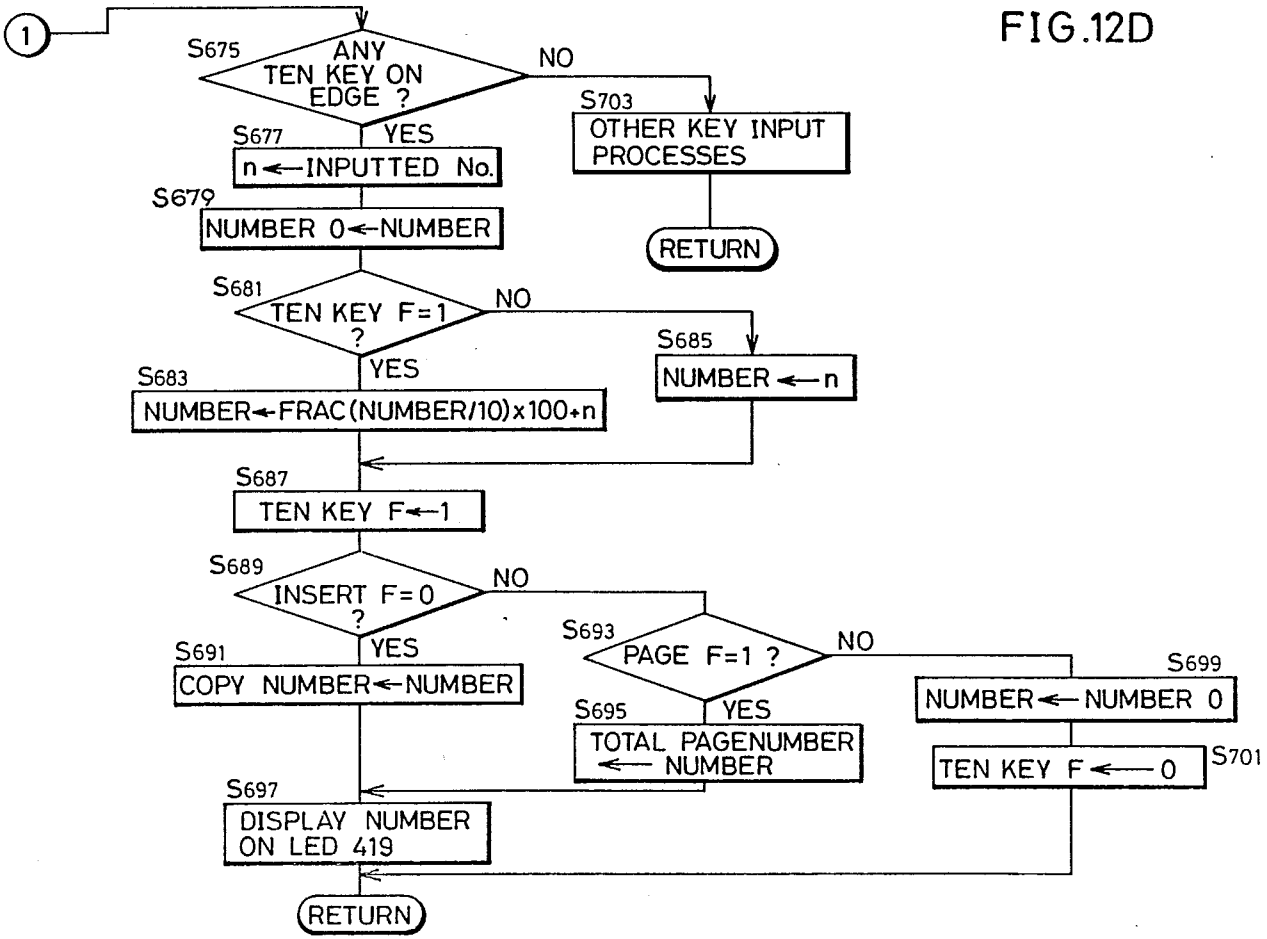

The timer interruption routine will be described with reference to FIG. 11.

The timer interruption routine is an interruption service routine executed in the CPU 21 in response to an interruption requesting signal generated by the timer IC at the end of operation of the timer T1 which is started in the above described image area interruption routine, or at the end of operation of the timers T2, T3, T4 and T5 which were started in the timer interruption routine.

More specifically, the CPU 21 stops the process which is presently being carried out and starts the process of the present interruption service routine upon reception of an interruption requesting signal from the timer IC.

At first, respective registers are saved (S401) in order to start again the interrupted process after the end of the interruption process.

Thereafter, whether or not the composite copy mode is set is checked (S403). The reason for this is that the processes to be carried out is different in copying the original and in entering the data when the composite copy mode is set. More specifically, in copying originals, a process for masking, the data entry area S439 to 477, and so on is carried out. Meanwhile, in entering data, the data entering process (S409 to S425 and so on) to the entry area is carried out.

If it is determined that the composite copying mode is set in the step S403, S403; YES), the flow proceeds to the step S405 to determine whether or not it is the data entering time.

<1> In copying original

When the composite copy mode is set (S403; YES) and data is not to be inserted, namely, the originals are to be copied (S405; NO), the program proceeds to the step S439 and the masking process for the entry area is carried out.

The masking process is carried out to prevent overlap of the entered data and the images of the original in the entry area.

Namely, when all the LED elements of the LED array 203 are off (S439; NO), all the LED elements are turned on (S441). The timer T5 is started (S443). By doing so, discharging by the LED array 203 is continued until the end of operation of the timer T5. The set value t5 of the timer T5 corresponds to the time period required for the photoreceptor drum 2 for rotating over the length of the entry area (the length in the subscanning direction=the peripheral direction of the photoreceptor drum 2).

Figure 13:
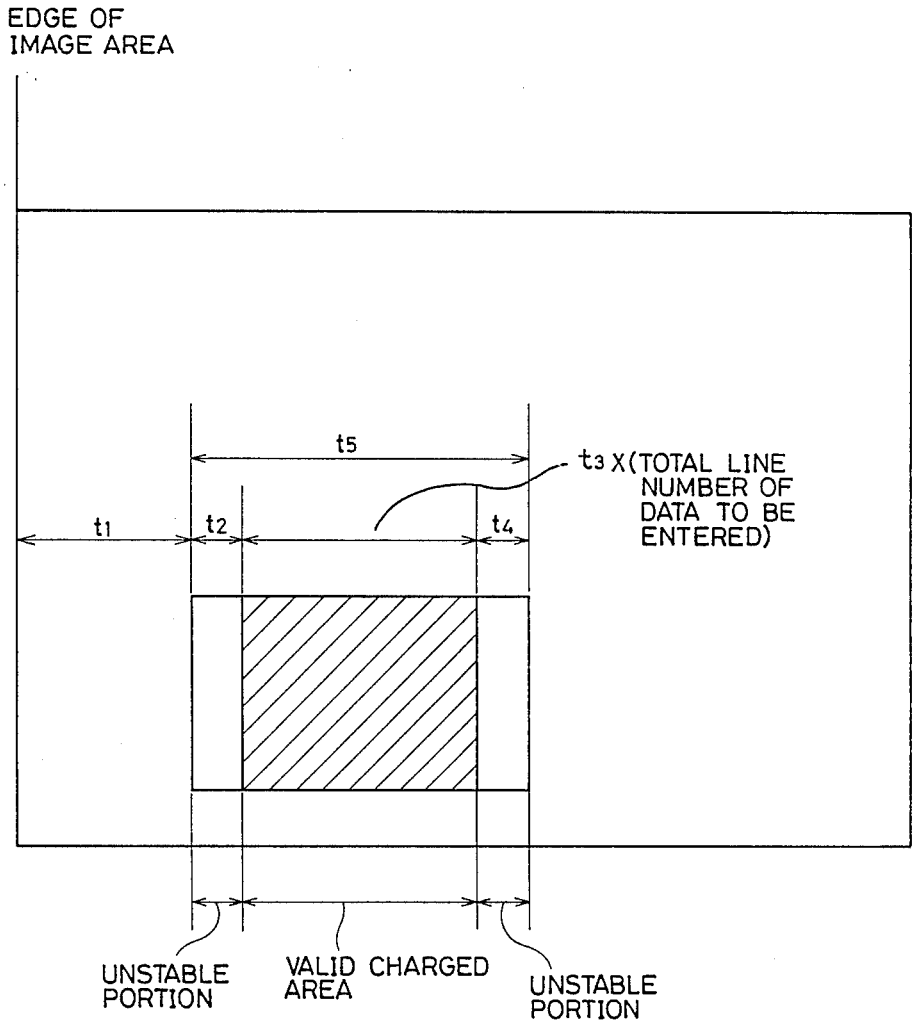
FIG. 13 illustrates relation between the entry area and timer values t1, t2, t3, t4 and t5.

The relation between the length of the entry area and the set value t5 of the timer T5 will be described with reference to FIG. 13. As is apparent from the figure, in the masking process, the area for entry includes the rising portion and the falling portion of the corona charger 202.

After the end of the above described process, data in the respective registers are restored (S4449), the present routine is terminated and the flow returns to the interrupted process.

When the present routine is carried out at the end of operation of the timer T5 (that is, at the end of discharging of the entry area), the process proceeds from the steps S401, S403, S405, S439 to the step S445 in which all the LED elements are turned off (S445). The counting of the timer is stopped (S447) and the timer interruption is masked.

<2> In entering data

When the composite copy mode is not set (S403; NO) or when the composite copying mode is set and the data is to be entered (S403; YES, S405; YES), whether or not the output of data to be entered (output to the shift register) is terminated is checked (S407).

a: At the time of rising

When it is determined that the output of the data to be entered has not yet been terminated in the step S407, the flow proceeds to the step S411 provided that the corona charger 202 of the inserting head 201 is OFF (S409; NO=what the interruption is generated by the end of operation of the timer T1). The corona charger 202 is turned ON. All the LED elements of the LED array 203 for entering data are turned on (S413). The operation of the timer T2 is started. Consequently, discharging by the LED array 203 is continued until the end of operation of the timer T2. The set value t2 of the timer T2 is enough to avoid writing of data to the unstable portion (a portion on which charging is not properly carried out) in the rise time of the corona charger 202 (see FIG. 13).

Thereafter, a first line of data to be entered (data for controlling turning on or off each dot of the respective LED elements in each line) are outputted to the shift register in the entry head 201 (S417).

After the end of the above described process the data of the respective registers are restored (S449). The present routine is terminated and the flow returns to the interrupted process.

b: Data insertion

When the present routine is carried out at the end of operation of the timer T2 (that is, when discharging of the unstable portion in the rise time of the corona charger 202 is terminated), the program proceeds from the steps S407 and S409 to the step S419 in which a latch pulse is outputted to the shift register. Consequently, an ON/OFF controlling signal is outputted to a driver of the LED array 203 from the shift register.

The operation of the timer T3 is started (S421). A value t3 is set in the timer T3 which is the time period corresponding to one dot length of a dot matrix font (the time period for keeping LEDs on for printing data of each line). Accordingly, when the operation of the timer T3 is terminated, the timer interruption of the next line is generated.

In the step S423, whether or not the output to the shift register of the last line of the pattern data is terminated is checked.

If the output of the pattern data has not yet been terminated (S423; NO), the font data of the next one line are outputted to the shift register (S425), and the flow proceeds to the step S449. The data of the respective registers are restored and the present routine is terminated. The flow returns to the interrupted process.

When the present routine is carried out at the end of the operation of the timer T3 (namely, the entry of data is continuously carried out), the processes of the steps S407, S409, S419, S421, S423, S425 and S449 are carried out repeatedly.

If it is determined in the step S423 that the data output is terminated, it means that there is no data, and therefore the flow directly proceeds to the step S449. The data of the respective registers are retrieved, the present routine is terminated and the flow returns to the interrupted process.

c: At the time of falling

If it is determined in the step S447 that the data output is terminated, the program proceeds to the step S429 provided that the corona charger 202 of the entry head 201 is ON (S427; YES=interruption is generated by the end of the final timer T3). All the LED elements of the LED array 203 for entry data are turned on. The corona charger 202 is turned OFF (S431). The operation of the timer T4 is started. Accordingly, the discharging by the LED array 203 is continued until the end of operation of the timer T4. The set value t4 of the timer T4 is enough to carry out discharging of the unstable portion in the fall time of the corona charger 202 (see FIG. 13).

After the end of the above described process, the data of the respective registers are restored (S449), the present routine is terminated, and the flow returns to the interrupted process.

When the present routine is carried out at the end of operation of the timer T4 (namely, when the discharging of the unstable portion in the fall time of the corona charger 202 is terminated), the process proceeds from the steps S407 and S427 to the step S435. The counting of the timer T4 is stopped (S437).

Thus, the timer interrupting process is terminated.

As is apparent from the foregoing, the set value t5 of the above mentioned timer T5 is represented by using the values T2, T3 and T4, as $$t5 = t2 + t3 \times (\text{total number of lines in the entry area}) + t4$$

The respective timers T2, T3, T4 and T5 are controlled by the timer IC as is the timer T1.

(6) Key input interruption routine

An interruption service routine called in the step S7 by any key input in the main routine of the CPU 22 shown in FIG. 8 will be described in the following with reference to FIG. 12.

The present routine is carried out in the step S7 of the main routine. The CPU 22 interrupts the process which is being carried out in response to the interruption instruction and carries out the present routine.

First, in order to start again the above mentioned interrupted process after the end of the present interrupting process, the data in the respective registers are saved (not shown).

Thereafter, which of the key input generated that interruption is checked (S601, S629, S649, and S675).

For example, in the step S601, whether or not the interruption is generated by an ON edge of the interruption key 402 is checked (S601).

<1> Date mode, page mode

If it is determined that the interruption is generated by the ON edge of the entry key 402 (S601; YES), the date entry mode and the page entry mode are set or released.

More specifically a ten key flag (described later) is reset (S603).

If the entry unit 200 is attached to the copying apparatus (S605; YES), the data flag is 0 (S607; YES, date non-entry mode) and the page flag is 0 (S609; YES, page non-entry mode), then a data entry mode is set.

Namely, the date flag is set, the page flag is reset (S611), the date LED403 is turned OFF and the page LED404 is turned OFF (S613).

If the entry unit 200 is attached to the copying apparatus (S605; YES) and the date flag is 0 (S607; YES, data non-entry mode) but the page flag is 1 (S609; NO, page entry mode), then the data entry mode and the page entry mode are set.

Namely, the date flag is set, the page flag is set (S615) the date LED403 is turned ON and the page LED404 is turned ON (S617).

If entry unit 200 is attached to the copying apparatus (S605; YES), the date flag is 1 (S607; NO, data entry mode) and the page flag is 0 (S609; YES, page non-entry mode), the page entry mode is set.

Namely, the date flag is reset, the page flag is set (S621), the date LED 403 is turned OFF and the page LED404 is turned ON (S623).

If entry unit 200 is not attached to the copying apparatus (S605; NO), or if the date flag is 1 (S607; NO, date entry mode) and the page flag is 1 (S609; NO, page entry mode) even when the entry unit 200 is attached, then the date entry mode and the page entry mode are both cancelled.

Namely, the date flag is reset, the page flag is reset (S625), the date LED403 is turned OFF and the page LED404 is turned OFF (S627).

The setting and cancelling of the date entry mode and the page entry mode are carried out in the above described manner.

After the end of the above described process, the data of the respective registers are restored (not shown) and the flow returns to the process which was carried out before the interruption.

<2> Insert mode

If the interruption is generated by the ON edge of the insert key 405 (S629; YES), setting or cancelling of the insert mode is carried out.

At first, the ten key flag (described later) is reset (S631). If the entry unit 200 is attached to the copying apparatus (S633; YES), either the data flag is 1 (S635; NO, date entry mode) or the page flag is 1 (S637; YES, page entry mode) and the insert mode has not yet been set (S639; YES), then the insert mode is set (S641, S643).

When the entry unit 200 is not attached to the copying apparatus (S633; NO), when neither the data entry mode nor the page entry mode is set (S635; YES and S637; NO) even if the entry unit 200 is attached (S633; YES), or when the entry mode has been already set (S639; NO) with the entry unit 200 attached (S633; YES), and either one of the date entry mode and the page entry mode is being set (S635; NO, or S637; YES), then the insert mode is cancelled. (S645, S647).

The turning ON/OFF of the insert mode is carried out in the above described manner.

After the end of the above described process, the data of the respective registers are restore (not shown) and the flow returns to the process which was carried out before interruption.

<3> Color selection

When the interruption is generated by an ON edge of any of the color select keys 412, 413 and 414 (S649; YES), then a color designating process is carried out.

First, the ten key flag (described later) is reset (S651).

An internal variable; n is substituted by the number of the selected color (key 412=1, key 413=2, key 414=3) (S653).

In the step S655, whether the color (n) developing unit for carrying out the developing operation in the color specified by color number n is attached to the copying apparatus or not is checked.

If the color (n) developing unit is not attached (S655; NO), the data in the respective registers are restored (not shown) and the program directly returns to the process stopped at the generation of the interruption.

If it is determined that the above mentioned color (n) developing unit is attached in the step S655, the process following the step S657 is carried out.

More specifically, if the insert flag is set (S657; YES) and a composite unit 103 is attached to the copying apparatus (S659; YES), then the selected color is set as the color for inserting data (S661). Namely, the variable "entry data color" is substituted by the data "color (n)".

The color for copying the original is compared with the color for entering data (S665). If they are the same (S665; NO), a normal copying mode is set. If they are different from each other (S665; YES) the composite copying mode is set (S667, S669).

If the insert flag is not set (S657; NO), then the selected color is used as the color for copying the original (S663). Namely, the variable "copy color" is substituted by the data "color (n)". The normal copying mode is set as the copying mode (S669). If the insert flag is set but the composite unit 103 is not attached (S659; NO), then the data of the respective registers are restored (not shown) and the program directly returns to the process which was interrupted by the generation of the interruption.

The LED indication (any one of the LEDs 416, 417 and 418) corresponding to the selected color is turned on (S671, S673).

Thereafter, the data of the respective registers are restored (not shown), and the flow returns to the process which was stopped at the generation of interruption.

<4> Ten key processing

When the interruption is generated by an ON edge of any of the ten keys in the ten key group 415 (S675; YES), then the ten key processing is carried out.

First, an input numerical value substitute for the internal variable; (n) (S677).

The number of pages which have been set by the last operation is substituted for an internal variable; number 0 (S679) and saved to be maintained.

In the step S681, the ten key flag is checked (S681).

If the ten key flag is 0 (S681; NO), it means that the key input process of the last operation is not in accordance with an input from the ten key, and therefore the number data has not yet been applied. Therefore, the above mentioned n substitutes for the internal variable; number (S685).

Meanwhile, if the ten key flag is 1 (S681; YES), it means that the last key input process corresponds to an input from the ten key. In that case, the number set in the last operation is moved to the second digit and the number inputted in the present operation is inputted in the first digit (S683). Consequently, the number of two digits is set. The FRAC function provides a decimal part of a number inputted.

The ten key flag is set in the step S687.

The insert flag is checked in the step S689.

If the insert flag is not set (S689; YES), then the set number is employed as the copy number (S691).

Meanwhile, if the insert flag is set (S689; NO), the flow proceeds to the step S693 in which the page flag is checked. If the page flag is set (S693; YES), that is, if the mode for entering the page number is set, then the set number data is employed as the total page number (S695). Thereafter, the set copying number or the total page number is displayed of the display segment LED419 (S697).

If it is determined that the page flag is not set in the step S693, that is although it is the mode for entering data, the entering of the page number is not carried out, the ten key input is neglected. In the step S679, the number representing the number of pages up to the last operation saved as the internal variable number 0 is restored to the internal variable: number (S699), and the ten key flag is reset (S701).

Thereafter, the data of the respective registers are restored (not shown) and the flow returns to the process stopped by the interruption.

The processes in the CPUs 21 and 22 of the apparatus of the present embodiment are carried out in the above described manner.

As described above, according to the present invention, a copying apparatus having a function of entering data including a data entering apparatus for entering images of additional information and a paper re-feeding apparatus for composite copying comprises a first color designating apparatus for designating a color for developing the entered data and a second color designating apparatus for designating the color for developing original images. Therefore, a second color which is different from the first color can be designated. Consequently, a copying apparatus can be provided in which images of an original and images of additional information can be formed in two different colors.

In addition, according to the present invention, formation of images to be copied in the data entry area is inhibited when the operation for copying the images of the original is being carried out, thereby providing copied images with the said area left blank.

Thereafter, the copy paper is fed again by the re-feeding apparatus and the entered data are printed on the said area.

Therefore, the overlap of the images of the original with the printed image of the entered data can be prevented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A copying apparatus, comprising:

a table for mounting an original;

a photoreceptor;

first latent electrostatic image forming means for forming a first latent electrostatic image on said photoreceptor based on a image of said original;

means for supplying electric signal indicative of additional information;

second latent electrostatic image forming means for forming a second latent electrostatic image on said photoreceptor based on said electric signal;

a plurality of developing means containing toners of different colors for turning said latent electrostatic images formed on said photoreceptor into toner images;

first designating means for designating a color of a toner by which the first latent electrostatic image formed by said first latent electrostatic image forming means is to be developed;

second designating means for designating a color of a toner by which the second latent electrostatic image formed by said second latent electrostatic image forming means is to be developed;

transferring means for transferring the toner images on said photoreceptor onto a sheet of copy paper at a transferring position;

paper re-feeding means for feeding again the sheet of paper on which the toner images have been transferred to said transferring position;

means for determining whether or not said color of the toner designated by said first designating means is the same as said color of the toner designated by the second designating means;

first controlling means controlling the copying apparatus such that said first and second latent electrostatic images are simultaneously formed by said first and second latent electrostatic image forming means on said photoreceptor, developed by the toner of said designated color to be transferred onto said sheet of copy paper, when the colors of the toners designated by said first and second designated means are the same; and second controlling means for controlling the copying apparatus such that said latent electrostatic image is formed by either one of said first and second latent electrostatic image forming means, developed by the toner of said designated color to be transferred onto said sheet of copy paper, thereafter said sheet of copy paper is again fed to the transferring position by said paper re-feeding means, and the latent electrostatic image is formed by the other one of said latent electrostatic image forming means, developed by the toner of said designated color to be transferred onto said sheet of paper fed again to said transferring position, when the colors of the toners designated by said first and second designating means are different from each other.

2. A copying apparatus according to claim 1, wherein said second latent electrostatic image forming means forms said second latent electrostatic image on that area of said photoreceptor which is different from the area on which said first latent electrostatic image is formed.

3. A copying apparatus according to claim 2, wherein said photoreceptor comprises a drum shape with opposing ends provided in an axial direction, and said second latent electrostatic image forming means is provided facing, and movable in the axial direction of, said photoreceptor drum.

4. A copying apparatus according to claim 3, wherein a first dimension is defined by said opposing ends of said photoreceptor drum, said second latent electrostatic image forming means has a second dimension in said axial direction, and said second dimension is shorter than said first dimension.

5. A method for copying images, comprising the steps of:

forming a first latent electrostatic image on a photoreceptor based on an image of an original;

forming a second latent electrostatic image on a photoreceptor based on an electric signal indicative of additional information;

designating a first color of a toner by which said first latent electrostatic image is to be developed;

designating a second color of a toner by which said second latent electrostatic image is to be developed;

determining whether or not said first and second colors of the toner are the same;

simultaneously forming said first and second latent electrostatic images on the photoreceptor and developing the same by said designated first color of the toner to transfer the same on a copy paper, when said first and second colors of the toners are the same; and forming said first latent electrostatic image on said photoreceptor, developing the same by said first color of the toner, transferring the same on said sheet of copy paper, forming said second latent electrostatic image, developing the same by said second color of the toner and transferring the same on said sheet of copy paper on which said first color of the toner has been transferred, when said first color of the toner is different from said second color of the toner.

6. A method for copying images for forming an image of an original and an image of additional information in association with said image of the original on a sheet of copy paper, comprising the steps of:

forming a first latent electrostatic image on a photoreceptor based on the image of said original;

designating an area on which said additional information is to be written on said photoreceptor;

erasing charges on the area on which said additional information is to be written of the first latent electrostatic image formed on said photoreceptor;

developing said first latent electrostatic image in a first color of a toner to transfer the same on said sheet of copy paper;

forming a second latent electrostatic image on said photoreceptor based on an electric signal indicative of said additional information; and developing said second latent electrostatic image by a second color of a toner to transfer the same on said sheet of copy paper on which the first color of the toner has been transferred.

7. A copying apparatus, comprising:

a table for mounting original;

a photoreceptor;

first image forming means for forming, by projecting an image of said original on said photoreceptor, an image of a first color based on said image on a sheet of copy paper;

composite copying means for forming an image again on said sheet of copy paper on which an image has been formed;

composite copying executing means for operating said composite copying means for forming said two images of the originals on said one sheet of copy paper;

means for supplying an electric signal indicative of additional information;

second image forming means for forming an image of the additional information in a second color on said sheet of copy paper by forming a latent electrostatic image on the photoreceptor in response to said electric signal;

first designating means for designating said first color;

second designating means for designating said second color;

means for determining whether or not the colors designated by said first designating means and by said second designating means are the same; and controlling means for controlling the copying apparatus such that an image is formed on said sheet of copy paper by either one of said first and second image forming means and thereafter an image is formed on said sheet of copy paper on which the image has been already formed by the other one of the image forming means by automatically setting active said composite copying means, when the colors designated by said first and second designating means are different from each other.

* * * * *

UNITED STATES PATENT AND TRADEMARK OFFICE

CERTIFICATE OF CORRECTION

PATENT NO. : 4,943,833

DATED : July 24, 1990

INVENTOR(S) : Shigenobu Fukushima

It is certified that error appears in the above-identified patent and that said Letters Patent is hereby corrected as shown below:

In col. 3, line 18, change "sane" to --same--.

In col. 5, line 7, change "continues" to --continuous--.

In col. 7, line 18, change "inserting" to --entry--.

In col. 7, line 22, change "a driver oft he" to --to a driver of the--.

In col. 10, line 20, after "process", insert --,-- (comma).

Signed and Sealed this

Eighteenth Day of February, 1992

*Attest:*

HARRY F. MANBECK, JR.

*Attesting Officer*

*Commissioner of Patents and Trademarks*